US006390201B1

(12) United States Patent
Coon et al.

(10) Patent No.: US 6,390,201 B1
(45) Date of Patent: May 21, 2002

(54) METHOD OF CREATING A DOWNHOLE SEALING AND HANGING DEVICE

(75) Inventors: Robert Joe Coon; Timothy John Frank, both of Houston, TX (US); Friedhelm Makohl, Celle (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/609,210

(22) Filed: Jul. 5, 2000

(51) Int. Cl.[7] ..... E21B 19/16; E21B 43/10
(52) U.S. Cl. ..... 166/380; 166/207
(58) Field of Search ..... 166/195, 207, 166/242.1, 380

(56) References Cited

U.S. PATENT DOCUMENTS 4,437,902 A * 3/1984 Pickens et al.
5,918,677 A * 7/1999 Head ..... 166/380
6,070,671 A * 6/2000 Cumming et al. ..... 166/381

FOREIGN PATENT DOCUMENTS

GB 2 344 606 A * 6/2000

OTHER PUBLICATIONS

Hosford, William F. and Robert M. Caddell, *Metal Forming Mechanics and Metallurgy*, 2nd ed., Prentice Hall, Englewood Cliffs, NJ, 1993, pp. 49–67.

Hosford, William F. and Robert M. Caddell, *Metal Forming Mechanics and Metallurgy*, 2nd ed., Prentice Hall, Englewood Cliffs, NJ, 1993, pp. 344–359.

* cited by examiner

*Primary Examiner*—David Bagnell
*Assistant Examiner*—Jennifer R. Dougherty

(57) ABSTRACT

A method of creating a downhole sealing and hanging device comprising the steps of lowering a first tubular in a well bore, then lowering through the first tubular a second tubular with slightly smaller external diameter than the internal diameter of the first tubular, and made of formable steel, in such a way that the upper section of the second tubular remains within the lower section of the first tubular, and finally plastically expanding at least the upper section of the second tubular by application of a radial force to the interior of the upper section of the second tubular thereby creating an interference fit capable of forming a bond and a hydraulic seal between the first and second tubular.

10 Claims, No Drawings

METHOD OF CREATING A DOWNHOLE SEALING AND HANGING DEVICE

FIELD OF THE INVENTION

The invention relates to a method of creating a downhole sealing and hanging device.

BACKGROUND OF THE INVENTION

Numerous methods are known that utilize material compression and slips to effect a seal and hang off system. The known methods have the disadvantage that the application thereof is restricted to tubulars with comparatively small diameters.

SUMMARY OF THE INVENTION

It is an object of the present invention to provide a method of creating a downhole sealing and hanging system that can be used for tubulars with larger inner diameters than currently available systems.

The present invention therefore relates to a method of creating a downhole sealing and hanging device comprising the steps of lowering a first tubular in a well bore, then lowering through the first tubular a second tubular with a slightly smaller external diameter than the internal diameter of the first tubular, and made of formable metal, in such a way that the upper section of the second tubular remains within the lower section of the first tubular, and finally plastically expanding at least the upper section of second tubular by application of a radial force to the interior of the upper section of the second tubular thereby creating an interference fit capable of forming a bond and a hydraulic seal between the first and the second tubular.

DETAILED DESCRIPTION

The radial force to the interior of the upper section of the second tubular is preferably exerted by means of an expandable tool which has been moved through the tubular to the section which has to be expanded. The expandable tool is suitably an expandable mandrel, e.g. a cone or roller system which can be expanded at the intended location, but it may also be an expandable hydraulic packer or a steel reinforced bladder which can be expanded by using hydraulic pressure. The expandable tool can be suitably operated at an internal pressure of at least 200 bar.

The selective plastic expansion may also be achieved through a localized explosion or by means of hydraulic pressure in between two temporary seals.

The tubulars may be made of almost all types of steel. The second tubular is however made of a high-strength steel grade with formability and having a yield strength-tensile strength ratio which is lower than 0.8, and a yield strength of at least 275 MPa. Moreover the material of the second tubular is preferably capable of sustaining a plastic deformation of at least 10% uniaxial strain.

It is also preferred that the second tubular is made of a formable steel grade having a yield stress/tensile stress ratio which is between 0.6 and 0.7.

Dual phase (DP) high-strength, low-alloy (HSLA) steels lack a definite yield point which eliminates Luders band formation during the tubular expansion process which ensures good surfaces finish of the expanded tubular.

Suitable HSLA dual phase (DP) steels for use in the method according to the invention are grades DP55 and DP60 developed by Sollac having a tensile strength of at least 550 MPa and grades SAFH 540 D and SAFH 590 D developed by Nippon Steel Corporation having a tensile strength of at least 540 MPa.

Other suitable steels are the following formable high-strength steel grades:

- an ASTM A106 high-strength low-alloy (HSLA) seamless pipe;
- an ASTM A312 austenitic stainless steel pipe, grade TP 304 L;
- an ASTM A312 austenitic stainless steep pipe, grade TP 316 L; and
- a high-retained austenite high-strength hot-rolled steel (low-alloy TRIP steel) such as grades SAFH 590 E, SAFH 690 E and SAFH 780 E developed by Nippon Steel Corporation.

Suitably the second tubular is expanded such that the external diameter of the expanded tubular is at least 5% larger than the external diameter of the unexpanded tubular. The strain hardening exponent n of the formable metal of the second tubular is advantageously at least 0.16.

Detailed explanations of the term strain hardening and the strain hardening exponent n are given in chapters 3 and 17 of the handbook "Metal Forming-Mechanics and Metallurgy", 2nd edition, issued by Prentice Mail, New Jersey (USA), 1993.

All types of tubulars may be connected with each other by means of the method according to the present invention. The method is especially suitable for tubulars to be used for casing, drilling and completion purposes.

The present method is also very suitable for installing a bridge plug in a tubular such that a tight connection is formed and the tubular is sealed off efficiently. In order to make the connection between the first and second tubular even stronger the second tubular which may be a bridge plug, preferably contains at least one slip element and/or hard metal or diamond coated button on the exterior of its upper section.

The slip element(s) and/or button(s) is(are) pressed into the interior wall of the lower section of the first tubular when the upper section of the second tubular is plastically expanded, thus forming very strong sealing and hanging device between both tubulars.

The downhole sealing and hanging devices made according to the present invention are almost always completely tight. A leak-proof seal can be provided in all cases by placing a sealing element between the interior of the lower section of the first tubular and the exterior of the upper section of the second tubular which sealing element is set during the plastic expansion of at least the upper section of the second tubular. Therefore such a sealing element is advantageously applied in the downhole sealing and hanging device made by means of the present method.

This method presents the following advantages:

1) Tubulars with larger inner diameters can be connected with each other than can be connected by currently available systems.
2) No moving parts are present in the present sealing and hanging device.
3) The present method can create as long a sealing area as desired through the use of an interference fit with the adjoining outer tubular.
4) An inner polished bore is created after expansion that can be utilized along with a seal assembly on another tubular to create a floating seal/junction of any desired length. The creation of such a polished bore and the use of a floating seal has many advantages in high temperature environments.

The present invention also pertains to a well provided with a first tubular and a second tubular which have been connected with each other by means of a downhole sealing and hanging device as created using the method described hereinbefore.

We claim:

1. A method of creating a downhole sealing and hanging device comprising the steps of:

lowering a first tubule into a well bore;

lowering through the first tubular a second tubular of formable metal, having a slightly smaller external diameter than the internal diameter of the first tubular and at least one slip element and/or hard metal or diamond coated button on its exterior, until the upper section of the second tubular remains within the lower section of the first tubular;

placing a sealing element between the interior of the lower section of the first tubular and the exterior of the upper section of the second tubular; and plastically expanding at least the upper section of the second tubular by application of a radial force to the interior of the upper section of the second tubular thereby setting said sealing element and creating a interference fit capable of forming a bond and a hydraulic seal between the first and the second tubulars.

2. The method of claim 1, wherein the second tubular is a bridge plug.

3. The method of claim 1, wherein the radial force to the interior of the second tubular is exerted by means of an expandable tool.

4. The method of claim 3, wherein the expandable tool is an expandable mandrel, a roller system, an expandable hydraulic packer or a steel reinforced bladder system, or the plastic expansion is achieved through a localized explosion or by means of hydraulic pressure in between two temporary seals.

5. The method of claim 3, wherein the expandable tool can be operated at an internal pressure of at least 200 bar.

6. The method of claim 1, wherein the material of the second tubular is capable of sustaining a plastic deformation of at least 10% uniaxial strain.

7. The method of claim 1, wherein the second tubular is made of a formable steel grade having a yield strength tensile strength ratio which is between 0.6 and 0.7, and a yield strength of at least 275 MPa.

8. The method of claim 1, wherein the second tubular is made of a dual phase (DP) high-strength low-alloy (HSLA) steel.

9. The method of claim 1, wherein the second tubular is expanded such that the external diameter of the expanded tubular is at least 5% larger than the external diameter of the unexpanded tubular and wherein the strain hardening exponent n of the formable metal of the second tubular is at least 0.16.

10. A well provided with a first tubular and a second tubular which have been connected with each other by means of a downhole sealing and hanging device as created using the method of any preceding claim.

* * * * *